US006669817B2

(12) United States Patent
Savela

(10) Patent No.: US 6,669,817 B2
(45) Date of Patent: Dec. 30, 2003

(54) DEVICE FOR USE IN CONNECTION WITH A FABRIC IN A PAPER MACHINE

(75) Inventor: Jyrki Savela, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/932,214

(22) Filed: Aug. 17, 2001

(65) Prior Publication Data

US 2002/0079077 A1 Jun. 27, 2002

Related U.S. Application Data

(63) Continuation of application No. PCT/FI00/00115, filed on Feb. 16, 2000.

(30) Foreign Application Priority Data

Feb. 18, 1999 (FI) ..... 990343

(51) Int. Cl.[7] ..... D21F 1/32
(52) U.S. Cl. ..... 162/274; 162/363; 134/122 R
(58) Field of Search ..... 162/198, 199, 162/270, 272–279, 263, 363, 374; 134/15, 122 R

(56) References Cited

U.S. PATENT DOCUMENTS

| | | | | | |
|---|---|---|---|---|---|
| 1,501,179 | A | * | 7/1924 | Peacock et al. | 162/279 |
| 2,043,415 | A | * | 6/1936 | Lapeyrouse | 162/279 |
| 2,142,711 | A | * | 1/1939 | Brich | 162/274 |
| 2,245,109 | A | * | 6/1941 | Lapeyrouse | 162/274 |
| 3,140,225 | A | * | 7/1964 | Truxa | 162/352 |
| 3,397,111 | A | * | 8/1968 | Rickert, Jr. | 162/279 |
| 3,786,975 | A | | 1/1974 | Heymanns | |
| 3,830,691 | A | | 8/1974 | Truesdale et al. | |
| 3,841,910 | A | * | 10/1974 | Baker | 162/274 |
| 4,077,834 | A | | 3/1978 | Stark | |
| 4,474,644 | A | * | 10/1984 | Poulsen | 162/274 |
| 4,669,646 | A | | 6/1987 | Oinonen | |
| 5,147,508 | A | * | 9/1992 | Sweet | 162/279 |
| 6,306,262 | B1 | * | 10/2001 | Snellman et al. | 162/217 |

FOREIGN PATENT DOCUMENTS

| | | |
|---|---|---|
| DE | 109444 | 4/1900 |
| DE | 2139159 | 2/1973 |
| DE | 2510492 | 9/1976 |
| EP | 0 515 339 A1 | 11/1992 |
| FI | 3345/68 | 11/1968 |
| FI | 61535 | 8/1982 |
| FI | 102484 B | 12/1998 |
| FI | 79726 | 2/1999 |
| SE | 57283 | 10/1921 |
| WO | WO 00/49224 | 8/2000 |

* cited by examiner

*Primary Examiner*—Steven P Griffin
*Assistant Examiner*—Eric Hug
(74) *Attorney, Agent, or Firm*—Stiennon & Stiennon

(57) ABSTRACT

A device (10) for use in connection with a fabric (F) in a former or a press section of a paper machine comprises sub-assemblies which accomplish at least two of the following functions: guiding, spreading and/or cleaning of the fabric (F). The device (10) has an automatic guide (20) and a guide roll (40) for guiding the fabric (F), a curved spreader roll (30) for spreading the fabric (F), and a suction unit 19 for cleaning the fabric (F).

14 Claims, 4 Drawing Sheets

DEVICE FOR USE IN CONNECTION WITH A FABRIC IN A PAPER MACHINE

CROSS REFERENCES TO RELATED APPLICATIONS

This application is a continuation of PCT/FI00/00115, filed Feb. 16, 2000, and claims priority on Finnish Application No. 990343, filed Feb. 18, 1999, the disclosures of both of which applications are incorporated by reference herein.

STATEMENTS AS TO RIGHTS TO INVENTIONS MADE UNDER FEDERALLY SPONSORED RESEARCH AND DEVELOPMENT

BACKGROUND OF THE INVENTION

As known in the prior art, in connection with the wet end fabrics of a paper machine, for example, in guiding, spreading and cleaning of a felt in a press section, a separate device is used for each purpose, at least one of each of them being arranged for said purpose in connection with each fabric. In the arrangements known in the state of the art, the devices used for these purposes are an automatic guide, a manual guide, a guide roll, a curved spreader roll, suction units and jets. Such separate devices cause extra costs, they take space and require support structures in connection with the frame structures of the machine.

One problem with the suction units used in connection with the separate devices known in the prior art has been that the width of the suction slot has not always been adjustable so that several suction units may have been needed for each felt.

One problem in connection with suction units has also been that the suction unit rubs against the felt so that the press section consumes more power.

In the arrangements known in the state of the art, in fast machines in particular, the felt has worn quickly, which has been partly due to the rubbing of the ceramic covers of felt suction units. Rolls and mechanical impurities also wear felt.

The spreader rolls in the arrangements known in the prior art have had a constant curvature, and thus it has not been possible to adjust their spreading effect.

SUMMARY OF THE INVENTION

An object of the invention is to provide a device in which the above-noted problems with the prior art devices are not encountered.

An object of the invention is also to provide a device which is of low cost.

One further non-indispensable object of the invention is also to disclose a device in which the width of the suction slot in the suction unit is adjustable.

One further non-indispensable object of the invention is also to disclose a device in which the curvature of the spreader roll can be adjusted.

In accordance with the invention, the device comprises device components that accomplish at least two of the following functions: guiding, spreading and/or cleaning of a fabric. An advantageous embodiment example of the invention comprises the above-mentioned functions, all in the same device.

The device according to the invention thus comprises in accordance with an advantageous embodiment an automatic guide, a guide roll, a curved spreader roll and a suction unit in a single device assembly. Jets may also be incorporated in the device assembly.

In accordance with an advantageous additional feature of the invention, instead of prior known ceramic ribs, suction ribs that can be bent, for example, plastic ribs or equivalent are used as suction ribs of the suction slot of the suction unit, which is possible because the fabric is supported by rollers in the device. The adjustment of plastic ribs for regulating the width of the suction slot is easy to carry out and, when needed, the suction width can be increased, for example, at the edges with respect to the centre because the plastic rib is easy to bend.

Advantageously, in accordance with an additional feature of the device according to the invention, the journalling of the rollers (the guide roll and the spreader roll are formed of rollers) is accomplished by means of bearings lubricated with circulating grease or circulating oil or by means of permanently lubricated bearings, and the device can be turned upside down by using a hydraulic motor or cylinder for the purpose of cleaning. Advantageously, the end seals of the suction slot in the suction unit of the device are accomplished, for example, by means of adjustable overlapping joints. The suction pipe system of the suction unit is laid from both the driving side and the tending side, thus achieving a good and uniform suction effect.

The functions of the curved spreader roll are provided by placing the rollers forming the spreader roll in a form which is suitably curved. In a press section, the deflections of tubular rolls can be compensated for, for example, by placing the rollers at the edges of the machine at different heights using, for example, spacer plates under the bearing housings.

In felt guidance, the manual guide of the prior art arrangements has been omitted and the automatic guide is most preferably accomplished as a mechanical guide comprising linear guides and a worm gear, whereby the problems of known devices are avoided. The automatic guide is provided with such a movement length that no separate manual guide is needed. The movement length is, for example, 140 mm. In connection with the device in accordance with the invention, as a measuring head is advantageously used a non-contacting sensor or a contacting measuring transducer, i.e. a felt and wire tracking device.

The invention provides substantial savings in costs as the space requirement and the complexity of the device assembly are reduced. When used on fast machines, the service life of the fabric increases if the wear of the felt loop constitutes the main reason for replacement of the felt. The other main reasons for replacement of the felt include, for example, hardening, clogging, contamination or scheduled shutdown.

Only one device according to the invention is needed for each fabric because the width of the suction slot of the suction unit part can be adjusted, which allows optimization to be accomplished for each individual felt.

The power consumption of the press is reduced because the suction unit is less rubbing and fewer rolls are used than in the prior art arrangements since separate guide rolls and spreader rolls are no longer needed as they have been formed of rollers in connection with the device.

Curvature, i.e the power of spreading, can be regulated, in which connection the spreading effect can be regulated, and automatic control is self retaining retaining owing to a trapezoid-thread screw used in accordance with an advantageous example. It is easy to add automation to the device according to the invention, for example, controls and their automation can be readily incorporated, which increases the means of affecting the felt loop, for example, the profiling of the moisture of the felt by adjusting the width of the suction slot.

In the following, the invention will be described in more detail with reference to the figures of the accompanying drawing, to the details of which the invention is, however, not by any means intended to be narrowly confined.

DESCRIPTION OF THE PREFERRED EMBODIMENTS

Figure 1:
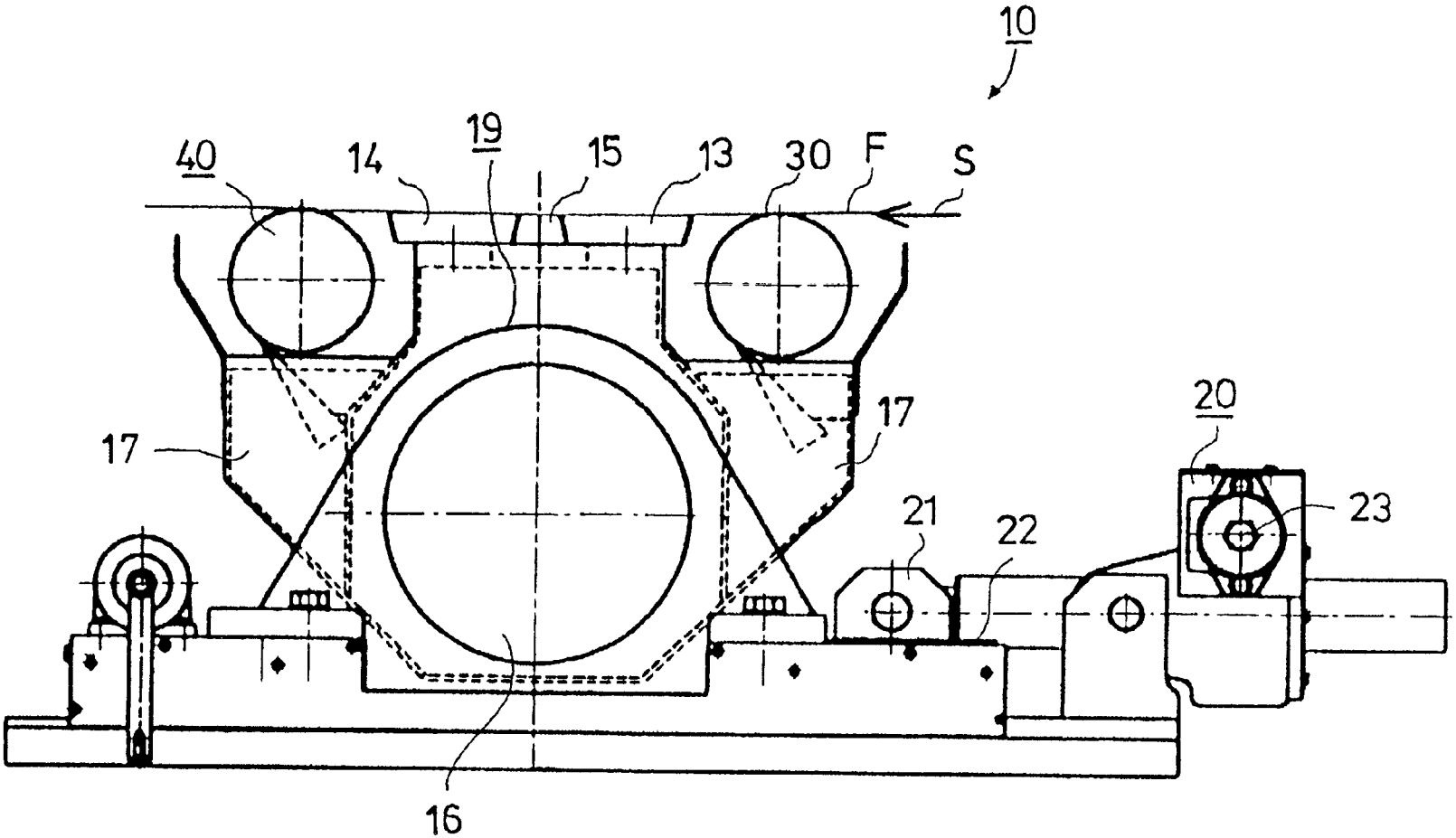
FIG. 1 schematically depicts one advantageous embodiment of the device according to the invention when viewed from the end.
Figure 2:
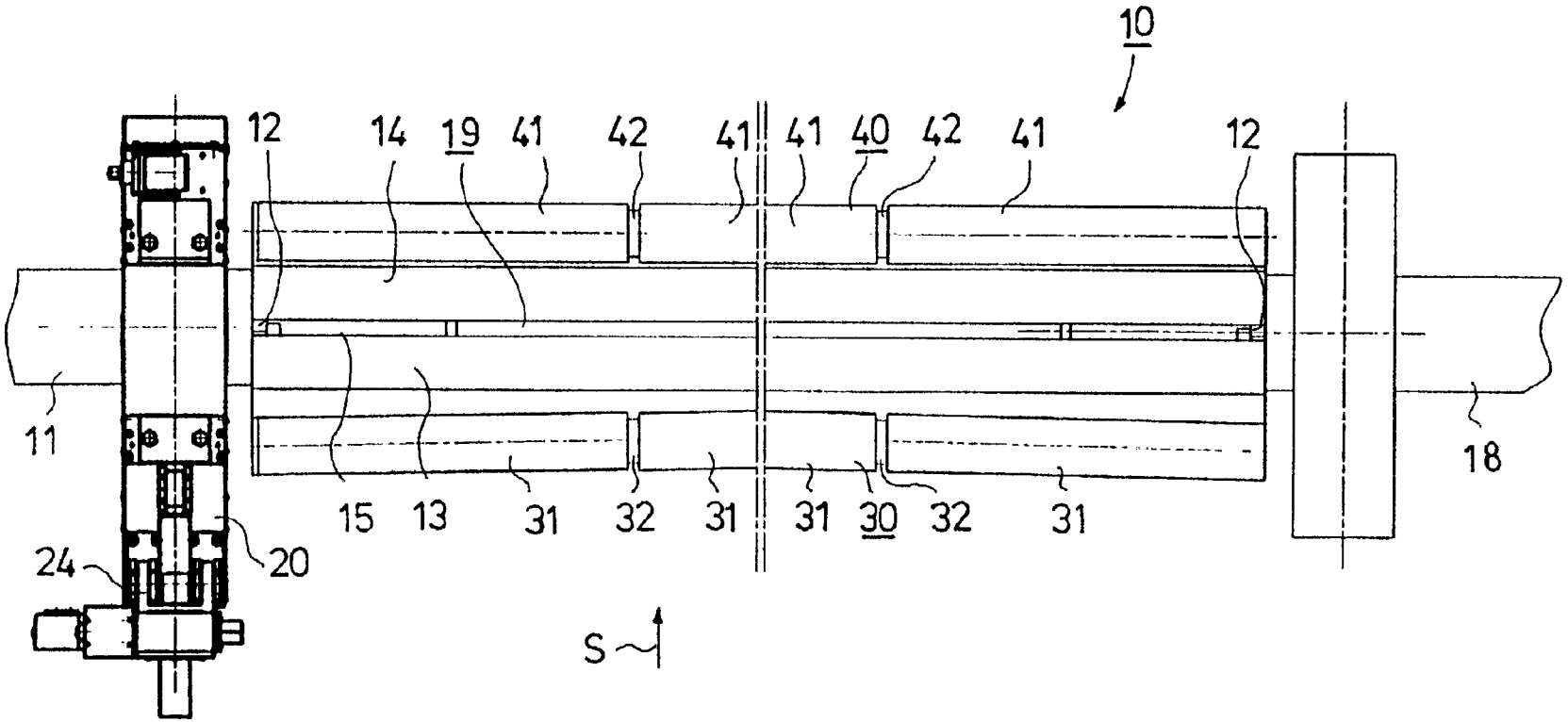
FIG. 2 schematically depicts the device illustrated in FIG. 1 when viewed in the longitudinal direction.

The advantageous embodiment example of the invention shown in FIGS. 1 and 2 comprises a suction unit part 19 which comprises a suction chamber 16 connected to the driving and tending sides by means of suction pipes 11 (tending side) and 18 (driving side). An adjustable suction slot 15 is formed between bendable suction ribs, preferably plastic ribs 13 and 14, a fabric F being passed to run over said suction slot 15 in a direction S. A spreader roll 30 which is adjustable in its curvature has been placed before the suction ribs 13, 14 in the running direction of the fabric F, which spreader roll is formed of rollers 31 between which adjustable bearing housings 32 have been placed, said bearing housings enabling the set of rollers formed by the rollers 31, i.e. the spreader roll 30, to be made curved. A guide roll 40 made up of rollers 41 and bearing means 42 therebetween has been placed on the outlet side of the suction slot 15. An automatic guide 20 comprises linear guides 22 and a worm gear 23 as well as a movement base 21 and advantageously a trapezoid-thread screw 24. Doctor boxes of the device 10 have been denoted with the reference numeral 17 and end seals of the suction slot 15 with the reference numeral 12. The end seals 12 may be, for example, adjustable seals based on an overlapping joint. The suction ribs 13, 14 are adjustable in position and bendable for adjusting the suction slot 15.

The device in accordance with the invention thus comprises according to the advantageous embodiment shown in FIGS. 1 and 2 an automatic guide 20, a guide roll 40, a curved spreader roll 30 and a suction unit 19 as a single device assembly. The adjustment of the suction unit part 19 and the suction ribs 13, 14 in order to adjust the width of the suction slot 15 is easy to accomplish, for example, by increasing the suction width at the edges with respect to the centre because the suction ribs 13, 14 can be bent to a desired position. Advantageously, the journalling arrangements of the rollers 41, 31 in the guide roll 40 and in the spreader roll 30 have been accomplished by means of bearings lubricated with circulating grease or circulating oil or by means of permanently lubricated bearings. The rollers 31, 41 can be placed at different heights at the edges of the machine by using, for example, spacer plates under the bearing housings. The device 10 can be turned upside down by using a hydraulic motor or cylinder (not shown) for the purpose of cleaning.

Figure 3:
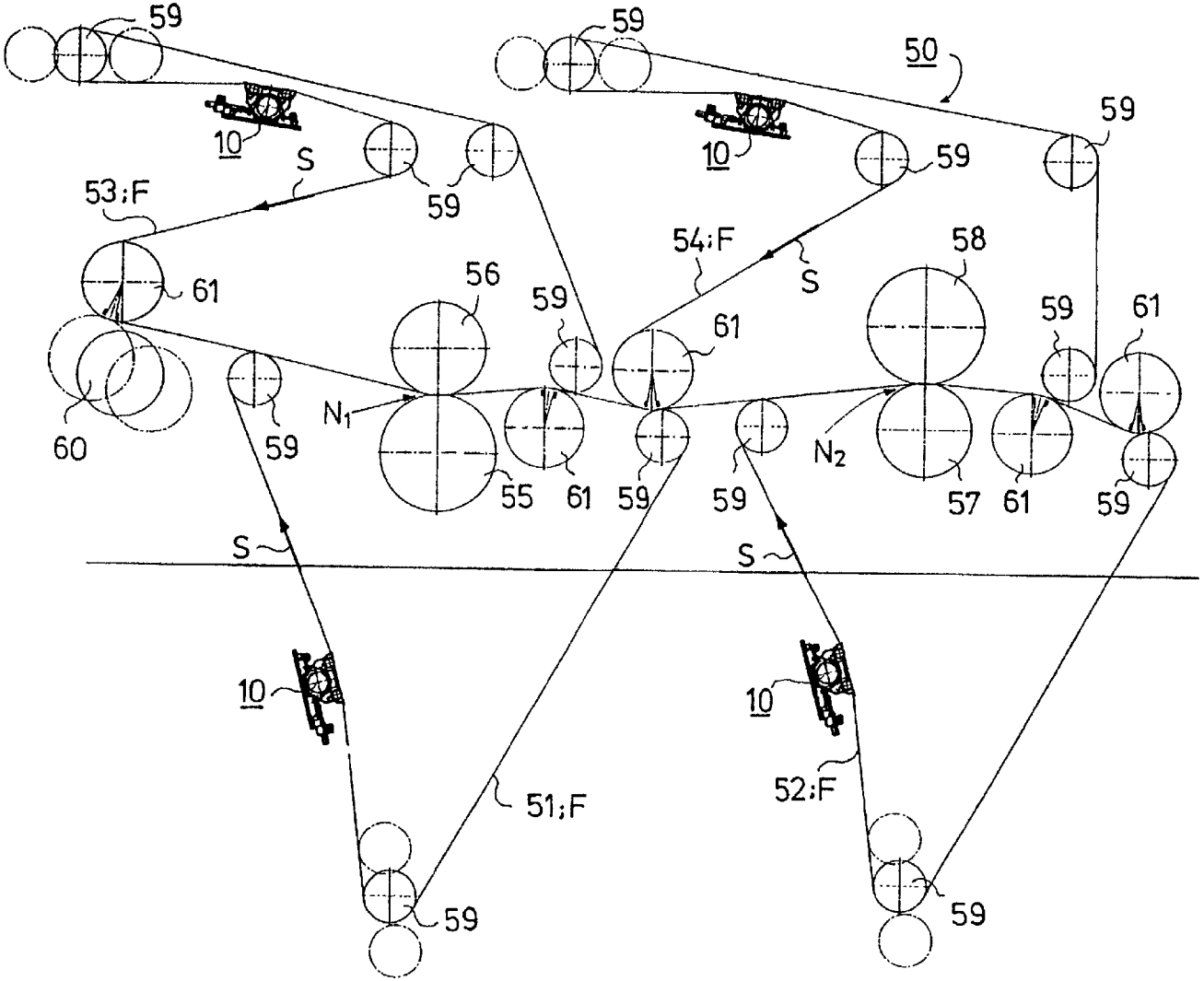
FIG. 3 depicts some possible applications of the device according to the invention for use in connection with press felts of a press section.

FIG. 3 shows a schematic application of a press section 50 in which devices 10 according to the invention have been placed in connection with fabrics F; 51, 52, 53, 54. The press section 50 illustrated in the figure comprises two press nips N1, N2 formed between press rolls 55, 56 and 57, 58, respectively. The guide rolls of the fabrics have been denoted with the reference numeral 59 and rolls which comprise a suction slot have been denoted with the reference numeral 61. A roll 60 adjustable in position is situated at the beginning of the press section in connection with a suction roll 61, a paper web being passed between said rolls from a former.

Figure 4:
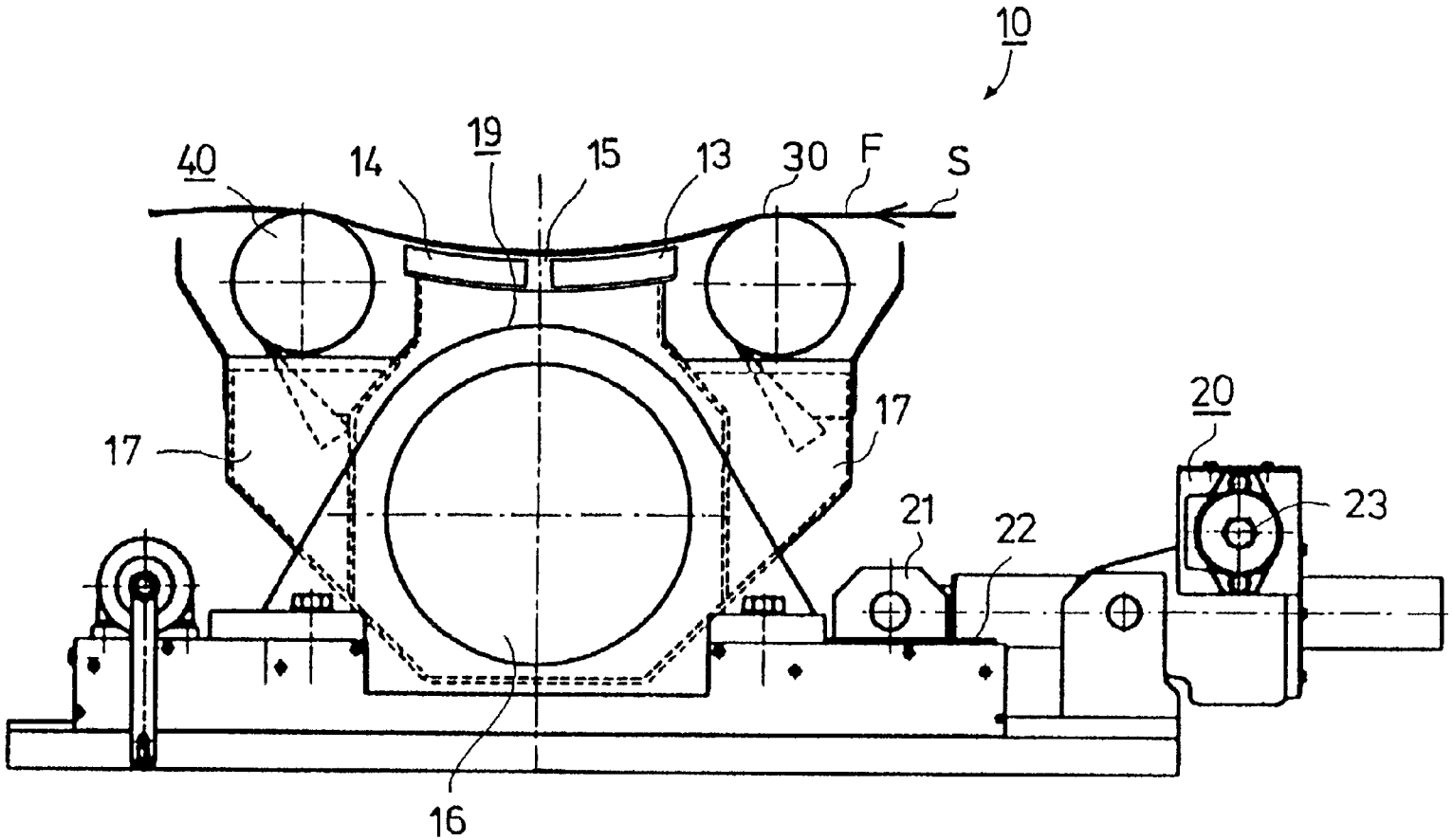
FIG. 4 schematically depicts one advantageous modification of the embodiment illustrated in FIGS. 1 and 2 when viewed from the end.

In the schematic modification of FIG. 4 of the embodiment shown in FIGS. 1 and 2, the position of the suction ribs 13, 14 is advantageously curved with respect to the fabric. In that connection, the fabric does not run straight but drawn into a curve, in which connection its friction is lowest. In other respects, the illustration of FIG. 4 corresponds to the embodiment shown in FIGS. 1 and 2. In FIG. 4, the parts corresponding to those of FIGS. 1 and 2 have been denoted with the same reference numerals.

A felt and wire tracking device is advantageously used in connection with the device according to the invention, said device being based on an angle sensor and on a flap lying against the edge of the felt as well as on a measuring head, in which the flap of the measuring head lying against the edge of the felt remains in contact with the edge of the felt by means of a compression spring placed inside an oil-containing cylinder, the structure of the return mechanism of said spring resembling the structure of a conventional shock absorber. Oil or an equivalent medium flows through a piston from holes making the movement of the flap more stable, and the return force is adjustable. Two measuring heads are used for each fabric, and the signal is filtered. An angle sensor of strong construction is used as the angle sensor of the measuring head, which withstands the amounts required for longitudinal and radial load, and the measuring member constructed inside its transducer is a non-wearing capacitive transducer operating without a mechanical contact. A sensor can be used both in the measuring head and as a position sensor of the guide, in which connection the adapting of output and input impulses is easy.

Above, the invention has been described only with reference to one of its advantageous embodiment examples, to the details of which the invention is not intended by any means to be narrowly confined. Many variations and modifications are feasible within the scope of the inventive idea defined in the following claims.

I claim:

1. A device for use in connection with a fabric, having a cross machine width, in a former a press section of a paper machine, the device comprising:

a subassembly accomplishing a guiding function of the fabric and the device further comprising at least one subassembly which performs a spreading function and a cleaning function across the entire cross machine width of the fabric and wherein the subassemblies form a single device;

wherein the subassembly accomplishing the guiding function comprises an automatic guide and a guide roll for guiding the fabric, the automatic guide for guiding the fabric having linear guides, and a movement base arranged to provide automatic guidance; and the at least one subassembly which performs a spreading function and a cleaning function comprises a curved spreader roll for spreading the fabric, and a suction unit for cleaning the fabric.

2. The device of claim 1 wherein the suction unit has a suction slot which can be adjusted and wherein the suction slot is formed between two suction ribs.

3. The device of claim 2 wherein the suction ribs are plastic ribs.

4. The device of claim 2 wherein the suction ribs can be adjusted in position and bent.

5. The device of claim 1 wherein the curved spreader roll is formed of rollers having adjustable bearing housings placed in spaces therebetween in order to adjust the curvature of the spreader roll.

6. The device of claim 5 wherein the curvature of the spreader roll of the device is regulated by adjusting the height position of the bearing housings.

7. The device of claim 1 wherein the subassembly accomplishing the guiding function of the fabric comprises a guide roll formed of rollers having bearings placed therebetween.

8. The device of claim 1 wherein the suction unit of the device has a suction chamber and suction tubes arranged therewith, one of said tubes extending to a tending side and the other to a driving side.

9. The device of claim 1 wherein the suction unit has a suction slot, and wherein end seals of the suction slot are based on an adjustable overlapping joint.

10. A device for use in connection with a fabric in a former or a press section of a paper machine, the device comprising:

a suction unit part having portions defining a suction chamber;

at least one suction pipe extending from the suction chamber;

a first bendable rib and a second bendable rib connected to the suction unit part to define a slot therebetween in communication with the suction chamber;

a spreader roll mounted to the suction unit part upstream of the slot, the spreader roll being adjustable to be curved;

a guide roll mounted to the suction unit part downstream of the slot, wherein the device is positioned such that the fabric passes over the spreader roll, across the first rib, the slot, and the second rib, and across the guide roll, and wherein the suction unit, the spreader roll and the guide roll form a single device incorporating an automatic guide for guiding the fabric having linear guides, and a movement base arranged to provide automatic guidance of the fabric.

11. The device of claim 10 wherein the first bendable rib and the second bendable rib are formed of plastic.

12. The device of claim 10 wherein the spreader roll is comprised of a plurality of rollers, adjustable to be curved and the rollers are mounted on adjustable bearing housings, for relative displacement of the spreader rollers.

13. The device of claim 10 wherein the first bendable rib and the second bendable rib are curved with respect to the fabric, such that the fabric as it passes over the ribs does not run straight, but is drawn into a curve.

14. The device of claim 10 wherein the guide roll is comprised of a plurality of rollers, adjustable to be curved.

* * * * *